US007251860B2

(12) United States Patent
Liang et al.

(10) Patent No.: US 7,251,860 B2
(45) Date of Patent: Aug. 7, 2007

(54) WINDOW ROTATING HANDLE

(76) Inventors: Luke Liang, 30 Spruce Hollow Rd., Green Brook, NJ (US) 08812; Toni Liang, Suite 1712, 195- Yanjing Road, Yanjiang Plaza, Guangzhou (CN)

( * ) Notice: Subject to any disclaimer, the term of this patent is extended or adjusted under 35 U.S.C. 154(b) by 30 days.

(21) Appl. No.: 11/133,136

(22) Filed: May 19, 2005

(65) Prior Publication Data

US 2006/0260099 A1 Nov. 23, 2006

(51) Int. Cl.
*A45C 3/00* (2006.01)

(52) U.S. Cl. ..... 16/429; 16/426; 74/547

(58) Field of Classification Search ..... 16/429, 16/426, 422, DIG. 41; 49/460, 324; 74/543, 74/547, 528; 296/218, 216.02; 292/347
See application file for complete search history.

(56) References Cited

U.S. PATENT DOCUMENTS 2,723,329 A * 11/1955 Baird ..... 200/330
5,560,082 A * 10/1996 Vetter ..... 16/429
6,598,265 B2 * 7/2003 Lee ..... 16/429
2003/0088941 A1 * 5/2003 Rotondi ..... 16/110.1
2004/0074051 A1 * 4/2004 Dawson ..... 16/422

* cited by examiner

*Primary Examiner*—J J Swann
*Assistant Examiner*—Mark T. Vogelbacker
(74) *Attorney, Agent, or Firm*—Thomas A. O'Rourke; Bodner & O'Rourke, LLP

(57) ABSTRACT

A window operator handle securable to a casement window operating drive shaft is described. The handle is movable between an operating position to a folded position. The handle has a body housing that has a cavity which includes an operating mechanism. The operating mechanism has an assembly body secured to the housing, a pivotal member positioned in a first section of the assembly body and a sliding member positioned in at least a second portion of the assembly body. The pivotal member is adapted to pivot from a first position to a second position as the handle is moved from a first position to a second position. The pivotal member is held in one position and the other position by the sliding member. The sliding member is retained in contact with the pivotal member by a spring means in said assembly body.

38 Claims, 8 Drawing Sheets

109
101
64
90
112
107
59
111
50

112
108
120
90
104
105
111
61
62

48
107
121
B
111
122
113
3
108
BL
90
49

A
A
48
55

60
57
61
48

103
105
123
57
3
122
102
106
121

113
105
106
120
55

WINDOW ROTATING HANDLE

FIELD OF THE INVENTION

The present invention is applicable to the wide variety of handles used for manual rotation of any mechanism that requires the application of force for such rotation. The present invention has a particular applicability when needs demand such handle to change its position relative to fixtures such handle is attached to. The handle has an ability to be folded when such handle is not in use to reduce inconvenience, damage or injury to passerby. One application of such handle is to use it with casement windows to drive the windows open and closed.

BACKGROUND OF THE INVENTION

Casement windows are manually operated windows where, in order to open and close them, it is necessary to rotate a handle attached to a drive mechanism of such window. A handle is attached to a rotating shaft of the window, which in turn, allows the window to be closed and opened through, for example, a rack that connects a window and a rotating shaft. Therefore, a manual handle is an important part of most casement windows. Because casement windows have become more and more popular among home owners because of their practicability, reliability and attractive appearance, a manual handle that operates such windows must follow a growing popularity of windows and respond to demands to be more technologically advanced.

When a window handle is not in use, i.e. when a window is not operated, the handle, which usually is attached to a window frame and extends outward from such window frame, causes many inconveniences; it may cause certain restraint for user's movement near the window or positioning of window's curtains, blinds etc., Therefore, it is preferable that when not in use, a handle is folded toward the window. First, it helps to create more attractive look. Secondly, a folded handle reduces the amount of inconvenience that such handle produces if projecting outward from a window. Unlike any other similar existing devices, the present handle's design allows the operator move the handle's position to either an "operating" or a "folded" position only. The present invention is compact and cost efficient. The design also has a construction that is wear-resistant that provides for prolonged use without breaking and a need for replacement.

SUMMARY OF THE INVENTION

An improved collapsible handle is provided that is attachable to a casement's window operating drive shaft to allow a window to be closed and opened by rotating the drive shaft. The design of the handle is such that it may be folded down when it is not in use. The handle has a knob attached to the body of the handle that may be grasped by the operator in order to rotate the handle. The body of the handle houses an assembly. The assembly has a first position where the handle is rotatable and a second position where the handle cannot rotate. The assembly within the body of the handle has a first or movable portion and a second relatively non movable portion. The second portion connects the assembly with the body of the handle. The movable portion of the assembly is connected with the drive shaft of the window. In the course of the pivotal movement of the movable portion of the assembly relative to the second portion, the assembly secures the handle in either an "operating" or a "folded" position. The second portion of the assembly has an assembly body and a sliding member. The sliding member may be supplied with an outward force by a resistance providing mechanism as the handle is folded and unfolded. The sliding member is positioned in the body of the handle in such manner that the sliding member is permitted to slide along the direction of the force created by the resistance providing mechanism. The resistance providing mechanism forces the sliding member to engage into a permanent contact with the movable portion of the assembly which may be configured as a pivotal member. The pivotal member couples the driving shaft of the window and the handle in pivotal relation to each other. The latter may have a semi-cylinder-shape surface at the place of the contact with the sliding member in order to induce the pivotal member to be positioned in either farthest point of the pivotal movement relative to the housing of the handle, and thus to secure the handle in either an operating or a folded position.

DETAILED DESCRIPTION OF THE INVENTION

Figure 1:
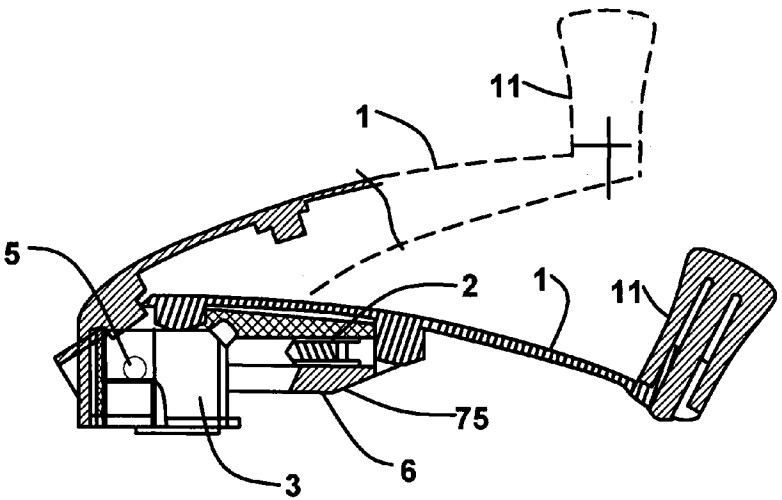
FIG. 1 is a cut-away side view of the window operating handle that shows trajectory of the window handle changing position from an "operating" position to a "folded" position.

The window handle of the present invention is designed to close and to open a type of window known as a casement window. This type of window is operable by rotating the shaft of the window by a handle attached to a shaft. As depicted in FIG. 1, the window handle may be in an "operating" position when it extends outwardly from the window frame, or in a "folded" position. The transition of the window handle from an "operating" to a "folded" position is depicted in FIG. 1. Preferably, even if the window operating handle is in a "folded" position, it may remain operable because the coupling between shaft of a window and a window handle remains intact.

Figure 4:
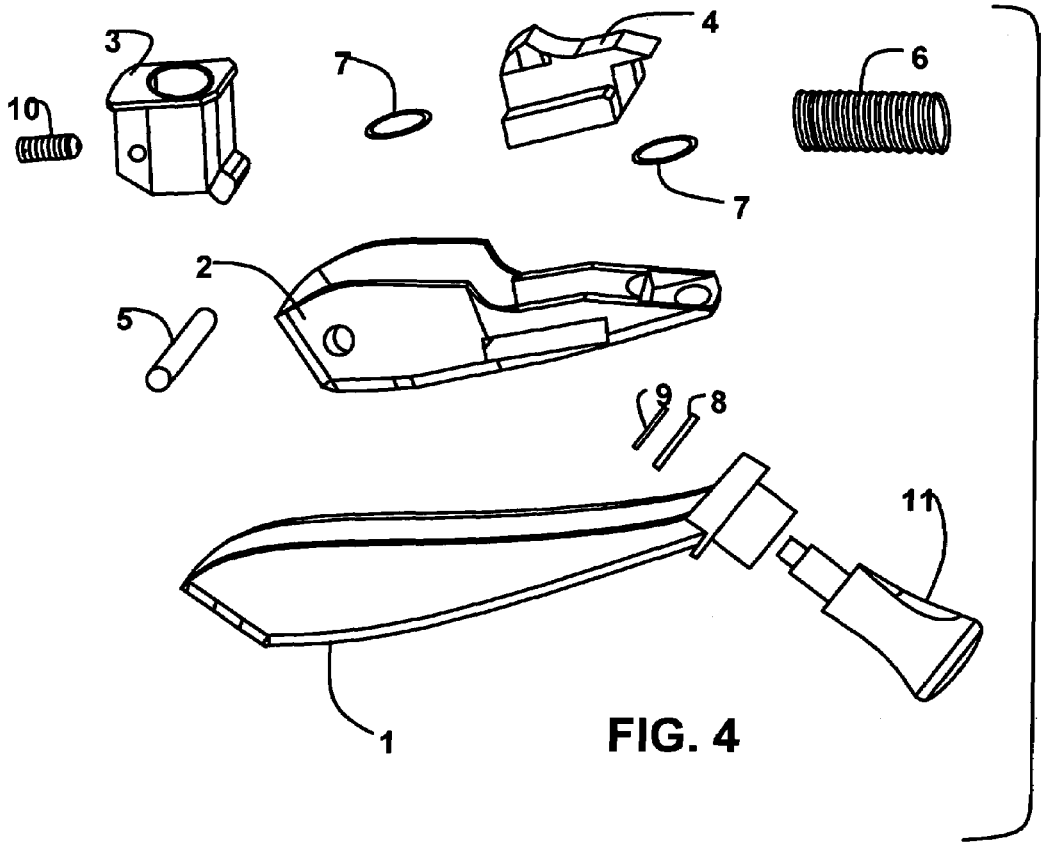
FIG. 4 is an exploded fragmentary prospective view of the window operator showing the components of the assembly separated from the body housing.

As depicted in FIG. 4, the window operating handle may include a manually graspable knob 11; a body housing 1, a assembly body 2, a pivotal member 3, a sliding member 4, a pin 5, a resistance providing device 6, body washers 7, knob washers 8 and 9, and a fastening member such as a screw 10.

Figure 5:
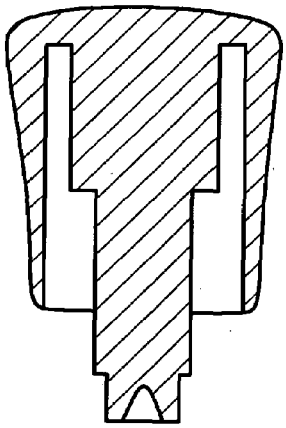
FIG. 5 shows a cut-away view of the handle's knob.
Figure 6:
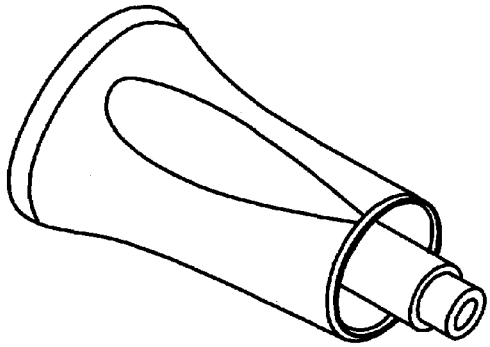
FIG. 6 shows a prospective view of the handle's knob.
Figure 10:
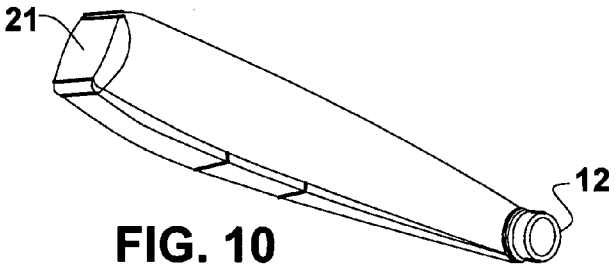
FIG. 10 shows a perspective view of the housing body of the window operating handle of FIG. 7.

The manually graspable knob 11 is depicted in detail in FIGS. 5 and 6. The knob may have a shape of a cone, and if it is, it may be slightly scooped from one side or two opposite sides of the exterior. Such configuration may be made to create a flat surface for more convenient grip while rotating the handle. There are various ways that the knob may be attached to the handle. For example, the knob may be mounted to the handle on its own central pin which may be integral part of the knob. In such configuration, an extending central pin may be inserted through an opening made in the handle and secured by forming the head at the end of a central pin. Or, instead of the knob with a central pin, there may be also a combination of the knob, solid or hollow inside, and an independent fastener of any suitable size and type that could be inserted through the knob and secure it to the handle. If the knob is configured to have extending integrated central pin, as shown in FIGS. 5 and 6, the body housing 1 may have an extension 12 in the shape of a hollow cylinder at the place where knob attaches to the handle, as depicted in FIG. 10. Such an extension would provide extra support to the knob in order to reduce knob's angular movement relative to the handle when knob and handle are assembled. The knob, when it positioned on the handle cylindrical extension of the housing body 1, is preferably capable of being revolved around its axis without undue friction with extension 12 of the handle, thus making rotation of the handle relative to the handle effortless.

If modification of the knob with the central extending pin is used, the knob's central pin may be inserted through the central hole made in the cylindrical extension 12 located generally in the end of the handle as depicted in FIG. 10. Flat washers 8 and 9, as depicted in FIG. 4, may be positioned upon the end of the extended central pin of the knob 11, although it may be one or no washers at all.

The housing body 1 is depicted in FIG. 4. The housing body 1 may have any suitable shape. As depicted in FIG. 4, the housing body has generally "U"-shape cross section. It may have slightly curved longer side to which end the knob 11 is attached, and relatively shorter side that may be approximately ¼ of the length of the longer side where outer line of shape of the handle is curved generally at about 135 degrees angle relative to the longer side.

Figure 2:
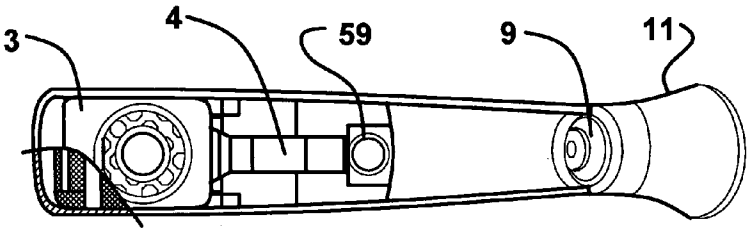
FIG. 2 is a partial upside-down cut-away side view showing window handle in a "folded" position.
Figure 11:
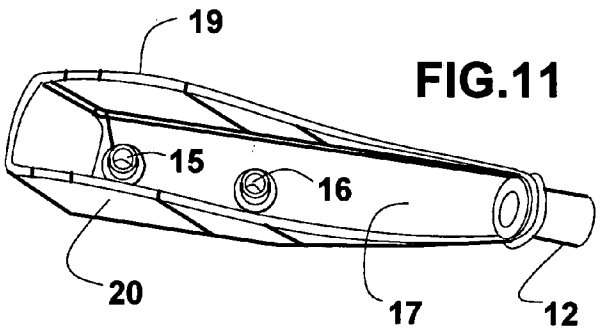
FIG. 11 shows an upside-down perspective view of the housing body of the window operating handle of FIG. 7.
Figure 12:
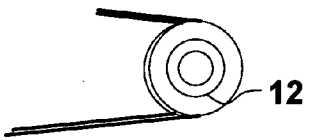
FIG. 12 is a partial view of the extension of FIG. 10.
Figure 7:
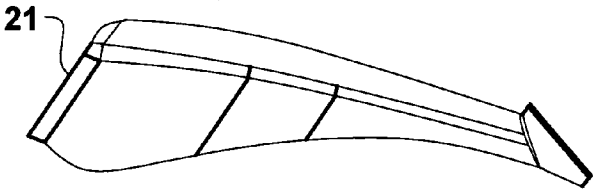
FIG. 7 is a side view of the housing body of the handle.
Figure 8:
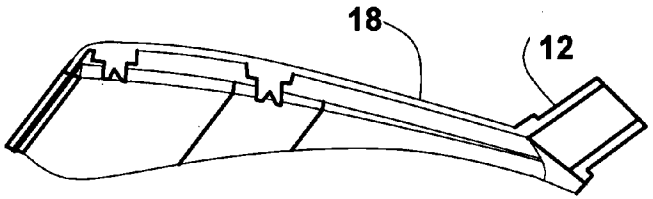
FIG. 8 is a cut-away side view of the housing body of the window operating handle of FIG. 7.
Figure 9:
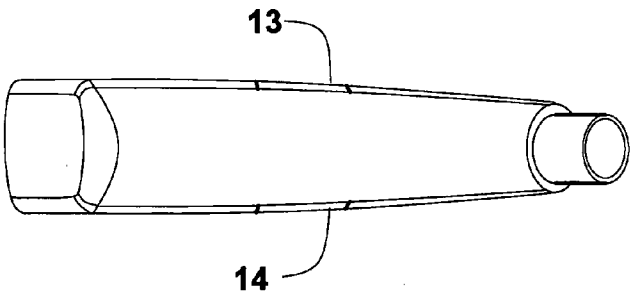
FIG. 9 is an alternative side view of the housing body of the window operating handle of FIG. 7.

As depicted in FIG. 2, the handle's width may gradually increase from the narrowest at the end of the handle where knob 11 is attached, to the widest at the opposite end. Side walls 13 and 14 of the handle may increase in height gradually from the lowest point near the knob to the highest point near opposite end, as shown in FIGS. 7 and 8. The housing body 1 may have two pillars 15 and 16 extending from the inner side of the housing body, as shown in FIG. 1. Such housing pillars 15 and 16 may serve with fasteners to position and attach the assembly body 2 to the housing body 1. The inner surface 17 of the housing body 1 is that portion of the housing body 1 between the side walls 13 and 14, as depicted in FIG. 11.

The shape of the assembly body 2 may preferably conform to the inner surface of the base wall 18, by the shape of surfaces 19 and 20 of the side walls 13 and 14 and by the outer surface of the wall 21. The assembly body 2 preferably rests on the inner surface 17 of the housing body 1 where orifices on the assembly body are used to secure the assembly body to the handle.

Figure 14:
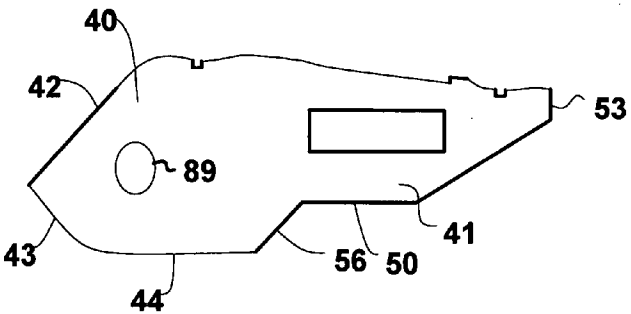
FIG. 14 is a side view of the assembly body of FIG. 13.
Figure 17:
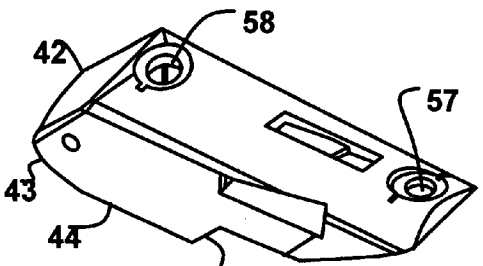
FIG. 17 is an upside-down perspective view of the assembly body of FIG. 13.
Figure 18:
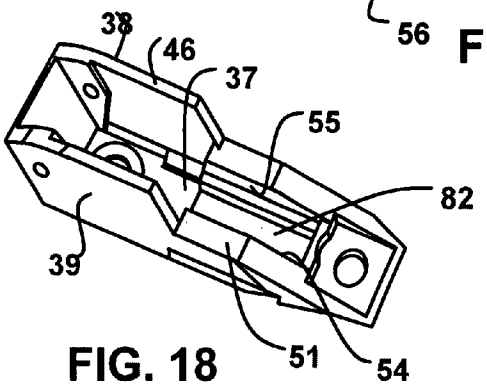
FIG. 18 is a perspective view of the assembly body of FIG. 13.
Figure 16:
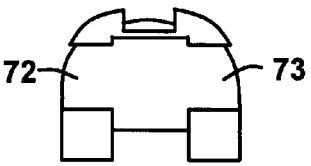
FIG. 16 is a view of the assembly body taken along the line B-B showed in FIG. 15.
Figure 13:
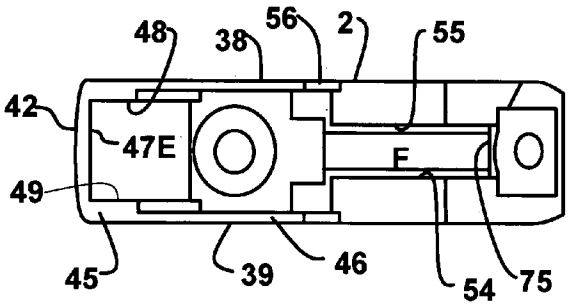
FIG. 13 shows an underneath view of the assembly body.
Figure 15:
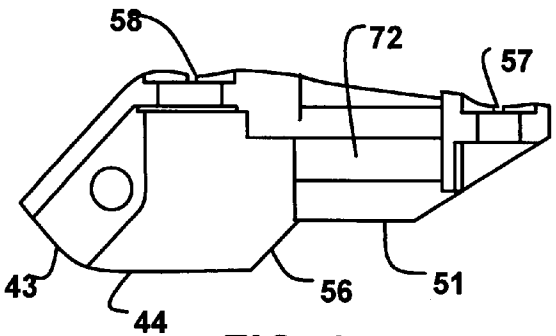
FIG. 15 is a cut-away side view of the assembly body of FIG. 13.

As depicted in FIG. 13 and FIG. 18, the assembly body 2 has side walls 38 and 39 that may extend upwardly from the base 37 and are positioned on the opposite sides of such base 37. As shown in FIG. 14, each side wall has a first sidewall portion 40 and a second sidewall portion 41. In addition, the sidewalls are joined by back wall 42, as shown in FIG. 18. The first sidewall portion 40 has two sections on its surface: section 43 and section 44, as shown in FIGS. 14 and 15. Section 43 of the first sidewall portion 40 extends from the back wall 42. As shown in FIG. 14, the top edge 45 of the first section 43 of the first sidewall portion 40 forms generally about a 90° angle with the back wall 42 and may, if desired, conform to the edge of the housing body 1 when the assembly body 2 rests on the inner surface 17 of the housing body 1. At the end of the first section 43 of the sidewall portion 40 there is a second section 44 of the first portion 40. The top edge 46 of the second section 44 of the first portion 40 of the side wall 38 may be parallel to the inner surface of the base wall 37 of the assembly body 2, and may also conform to the edge of the housing body 1 when the assembly body 2 rests on the inner surface 17 of the housing body 1. Edges 45 and 46 are joined by a curved section 43A if desired. Together, the inner surface 47 of the back wall 42 of the assembly body 2, the inner surface of the base wall 37 and both side walls 48 and 49 the first portion 40 of the assembly body form a cavity area E for receiving at least a portion of pivotal member 3. The second sidewall portion 41 of the assembly body 2 has a first section 50 extending from the inner surface of the base wall 37, generally having a top edge 51 which may be generally parallel to the base wall 37. At the end of the first section 50 of the second portion 41 there is a second section 52 with an edge surface 52A, and height of such second section 52 of the second portion 41 in relation to the base may gradually reduce from the point 53A where to edge 51 meets edge 52A. The tip 53 of the assembly body has an orifice 57 adjacent thereto for securing the assembly body to the handle. Together, the inner surface of the base wall 37, and the inner surfaces 54 and 55 of the second portion 41 of the sidewalls with sidewall 75 may form a second cavity area F. The first sidewall portion 40 and the second sidewall portion 41 are joined by central sidewall portion 56. The configuration of the top edges of the assembly body and top edges of the housing body 1 permits the assembly body 2 to preferably reside wholly in the cavity of the housing body 1.

The assembly body 2 generally may have a "U"-shape, conforming generally to the inner surface of the housing body 1 formed by the sidewalls 19 and 20, rear wall 21 and base surface 17. In a preferred embodiment, the shape of the assembly body makes it possible for the assembly body 2 to be tightly retained in the cavity 35 of the housing body 1. However, it will be appreciated that the angles between surfaces, configuration of the elements or the entire assembly body may vary. As shown in FIG. 13, an inner space of the assembly body 2 may have two cavities. The cavity E may accommodate the pivotal member 3 and the cavity F may house the sliding member 4 and the spring 6. There may be two apertures 57 and 58 made in the assembly body 2 that correspond to the pillars 15 and 16 of the housing body 1 and through which the assembly body 2 may be positioned on the housing body 1. As shown in FIG. 2, when the assembly body 2 is positioned in the housing body 1, heads 59 may be formed at the end of the pillars 13 to secure assembly body 2 relative to the housing body 1.

Figure 28:
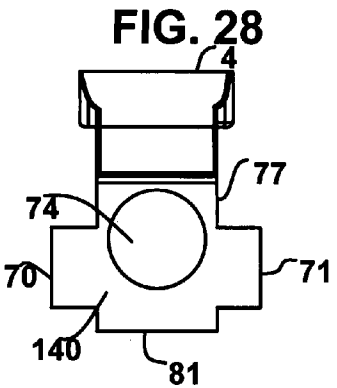
FIG. 28 is a front view of the sliding member of the window operating handle of FIG. 27 showing the sliding member from left side of FIG. 27.
Figure 34:
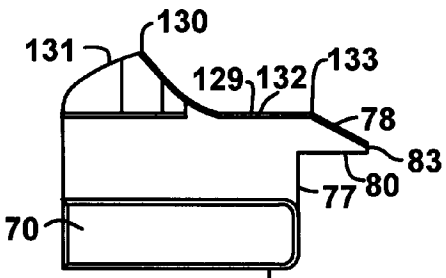
FIG. 34 is a side view of the alternative embodiment of the sliding member of the window operating handle.
Figure 35:
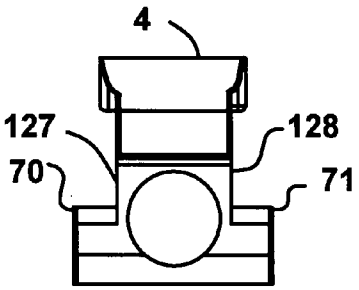
FIG. 35 is a front view of the alternative embodiment of the sliding member of the window operating handle of FIG. 34 showing the sliding member from the left.
Figure 40:
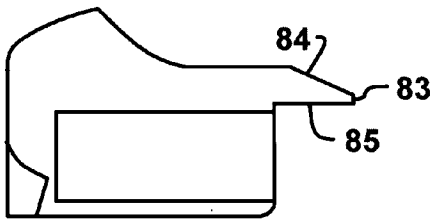
FIG. 40 is a cut-away side view of the alternative embodiment of the sliding member of the window operating handle taken along the line A-A shown in FIG. 39.
Figure 37:
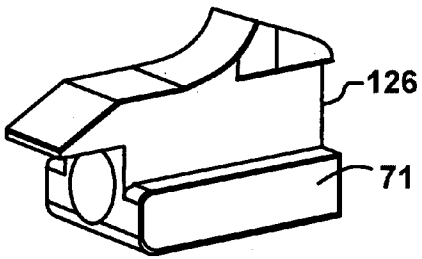
FIG. 37 is a perspective side view of the alternative embodiment of the sliding member of the window operating handle of FIG. 34 showing the sliding member from the front.
Figure 39:
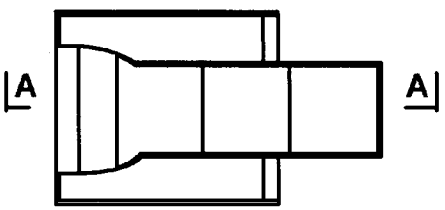
FIG. 39 is a top view of the alternative embodiment of the sliding member of the window operating handle of FIG. 34.
Figure 38:
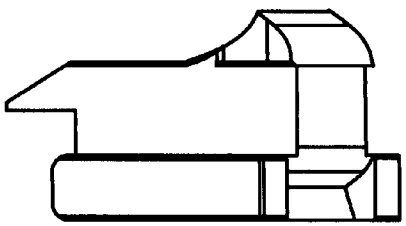
FIG. 38 is a perspective side view of the alternative embodiment of the sliding member of the window operating handle of FIG. 34 showing the sliding member from the rear.
Figure 42:
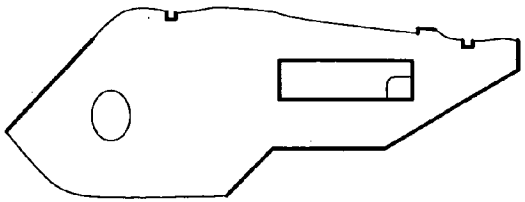
FIG. 42 is a side view of the alternative embodiment of the assembly body of FIG. 41.
Figure 45:
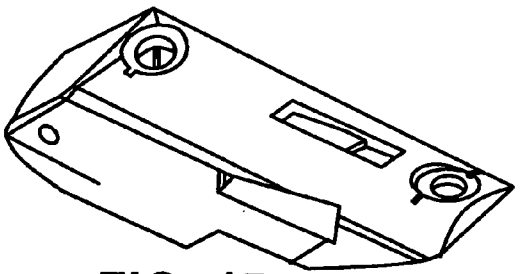
FIG. 45 is an underside perspective view of the alternative embodiment of the assembly body of FIG. 41.
Figure 44:
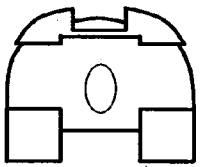
FIG. 44 is a view of the alternative embodiment of the assembly body taken along the line B-B showed in FIG. 43.
Figure 41:
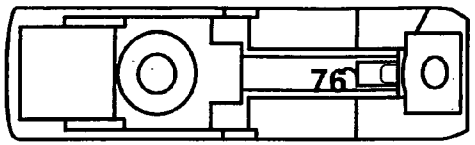
FIG. 41 shows an underneath view of an alternative embodiment of the assembly body.
Figure 43:
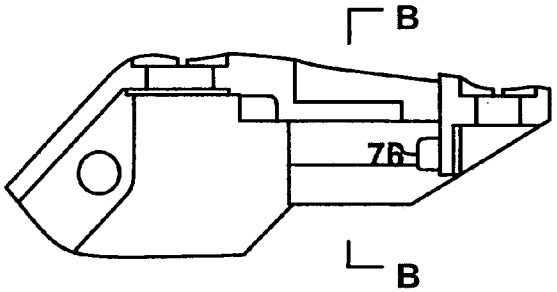
FIG. 43 is a cut-away side view of the alternative embodiment of the assembly body of FIG. 41.
Figure 46:
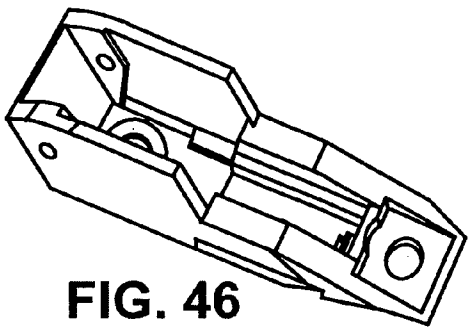
FIG. 46 is a perspective view of the alternative embodiment of the assembly body of FIG. 41.

Sliding member 4 may be generally rectangular in shape and may have a front 140 and a rear 141 with wings 70 and 71 extending outwardly on its base, as depicted in FIGS. 28 and 35. The purpose of the sliding member is to secure the handle in its "operating" position and alternatively its "folded" position. The wings 70 and 71, when positioned within grooves 72 and 73 of the assembly body 2 provide back-and-forth movement of the sliding element. There may be a horizontal blind bore 74 or other surface retaining means such as a pin which may accommodate a spring 6 which is aligned generally with the axis of symmetry of the sliding member 4. In one embodiment of the invention, the spring 6 may be positioned against the wall 75. In another embodiment, the spring 6 may be positioned on the protrusion 76, as depicted in FIG. 41. The protrusion 76 may extend inwardly from the inner wall 75. Such protrusion 75 may help to prevent a spring 6 from dislocation when such spring is positioned within the cavity F of the assembly body 2. An alternative embodiment of the assembly body may perform without such protrusion, as depicted in FIG. 13. The length and diameter of the protrusion 76 may vary and depend on the dimensions of the spring 6 and configurations of the sliding member 4. In the embodiment, as depicted in FIGS. 34 to 40, the lower portion 77 of the sliding member 4 from the side where the bore hole 74 is positioned may be configured in such manner that the diagonal top portion 78 and horizontal bottom portion 79 of the sliding member forms a hood-like tip 80, as shown in FIG. 34. Such configuration of the sliding member may be preferable if the embodiment includes the protrusion 76. As depicted in FIG. 1, sliding member 4 is capable of moving back and forth along the assembly body 2.

The assembly body 2 may have two grooves 72 and 73. These grooves form tracks for two wings 70 and 71 of the sliding member 4 to slide within the assembly body 2. In an alternative embodiment, the assembly body may have an additional groove 82 which may be present in the bottom of the sliding member 4, making a track for a supplementary edge 81 or longitudinal member that extends generally in the same direction as the movement of the sliding member. A spring 6 may be inserted into the blind bore 74 of the sliding member 4. Then the sliding member 4 is positioned within the assembly body in such way that the wings 70 and 71, are movably positioned within corresponding grooves 72 and 73. In an alternative embodiment, edge 81 of the sliding member is in groove 82, of assembly body 2 instead of the wings 70 and 71 in the grooves 72 and 73 or there can be the combination of the wings 70 and 71 and the edge 81 with the grooves 72, 73 and 82. Spring 6 is positioned on the protrusion 76 if assembly body is manufactured with such protrusion. Then sliding member is moved toward the protrusion 76 and the spring 6 is compressed. In the present embodiment, the resulting tip 83 may have top portion 84 and the bottom portion 85, as shown in FIGS. 34 and 40. In such configuration, the sliding member 4 may be positioned within the assembly body 2 where tip 83 faces the knob 11 and the sliding member 4 slides within the assembly body 2 in such manner that tip 83 extends over the top portion of the inner wall 53 of the assembly body 2 when the handle is in a "folded" position as shown in FIG. 1. In an alternative embodiment, the sliding member 4 may or may not be pressed against the inner wall 75 of the assembly body 2 when the handle is in a "folded" position as is desired.

As depicted in FIG. 18, the inner wall 75 of the assembly body 2 restraints the movement of the sliding member 4 toward the direction of the knob 11 when the sliding member 4 is positioned within the assembly body 2. By the force of the compressed spring 6 that is sandwiched between the inner wall 75 of the assembly body 2 and the sliding member 4, such sliding member is pushed toward the pivotal member 3. Thus, a spring 6 forces sliding member 4 to engage into contact with a pivotal member 3.

Generally, the pivotal member 3 may have several functions. Because the pivotal member 3 may be pivotally connected with the handle, the pivotal member 3 may define the position of the handle relative to the window shaft as a "folded" or an "operating" as depicted in FIG. 1. On the other hand, because the pivotal member 3 may be firmly connected with the window shaft (not shown), the pivotal member 3 conveys the revolving movement from the handle to the window shaft in order to operate the window.

Figure 3:
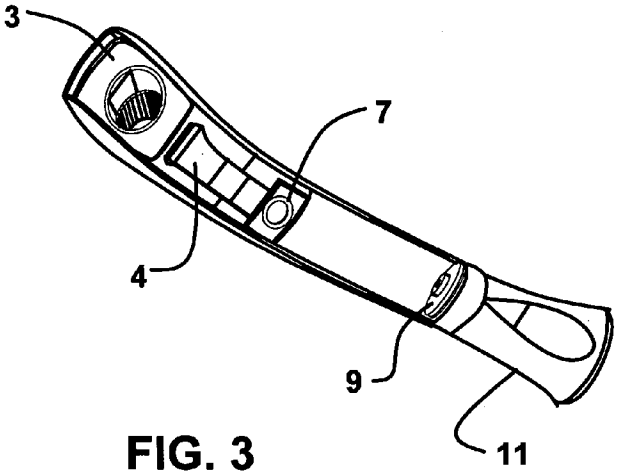
FIG. 3 shows a prospective upside-down view of the window operating handle in a "folded" position.

As depicted in FIGS. 1, 3, and 14, the pivotal member 3 may be placed into the cavity E of the assembly body 2, then pin 5 or any similar element may be inserted through an apertures 89 in the assembly body 2 and aperture 90 of the pivotal member 3. The assembly body 2 may be secured to the housing body 1 by forming heads 59 on the tips of pillars 15 and 16. Assembly body 2 is positioned within the housing body 1 in such manner that pillars 15 and 16 meet corresponding apertures 57 and 58 of the assembly body 2. Such configuration of the pivotal member 3, assembly body 2 and the housing body 1 may provide an ability for the pivotal member 3 to make pivoting movements within the cavity E of the assembly body relative to the housing body 1 around the pin 5.

Figures 19, 20, 21, 22, 23, 24, 25, 26:
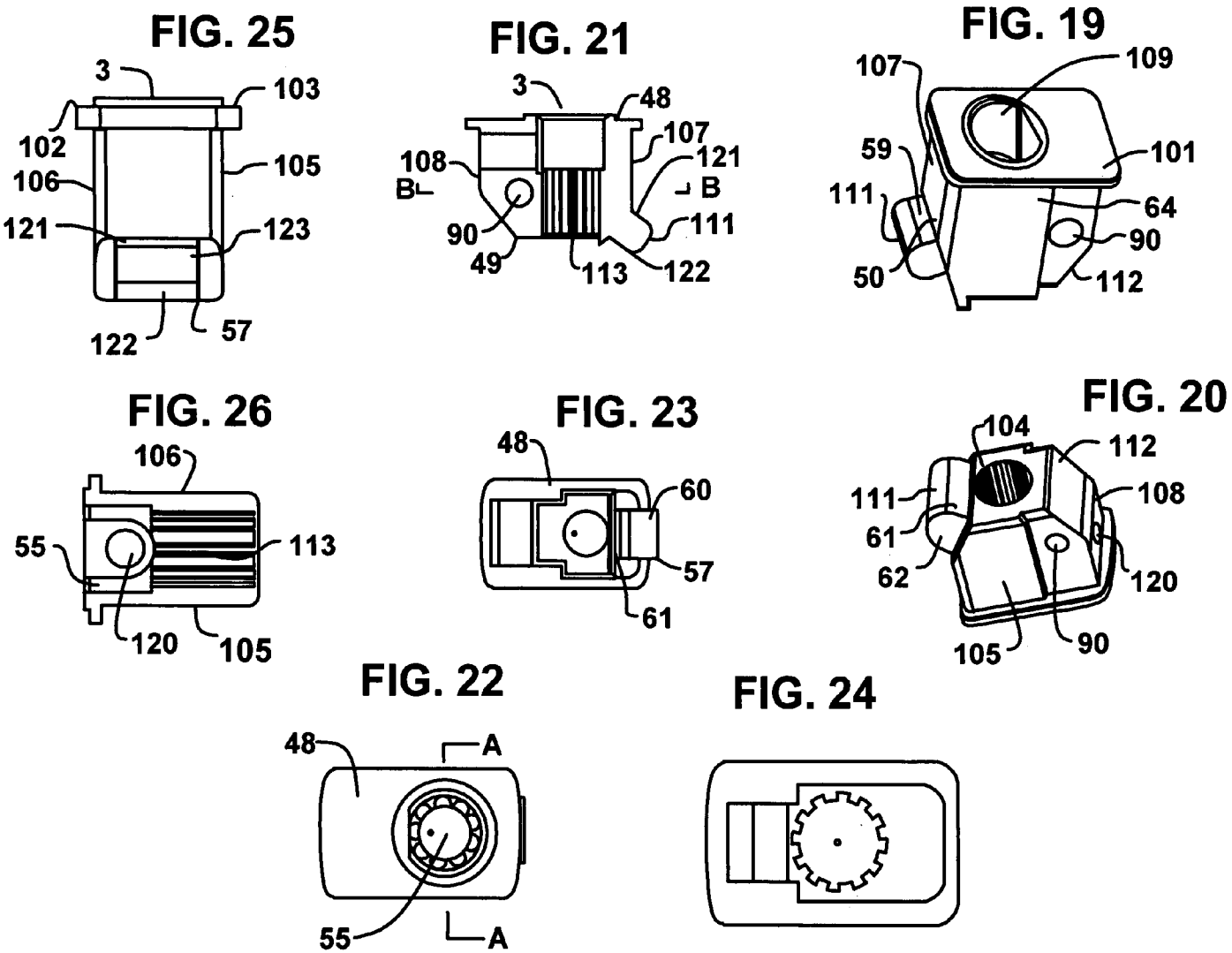
FIG. 19 is a top perspective view of the pivotal member.
FIG. 20 is a bottom perspective view of the pivotal member of FIG. 19.
FIG. 21 shows a cut-away side view of the pivotal member of FIG. 19.
FIG. 22 is a top view of the pivotal member of FIG. 19 showing the pivotal member.
FIG. 23 is a bottom view of the pivotal member of FIG. 19 showing the pivotal member.
FIG. 24 is a cut-away view of the pivotal member of FIG. 19 taken along the line B-B showed in FIG. 21.
FIG. 25 is a left end view of the pivotal member of FIG. 18.
FIG. 26 is a cut-away side view of the pivotal member taken along the line A-A showed in FIG. 22.
Figure 29:
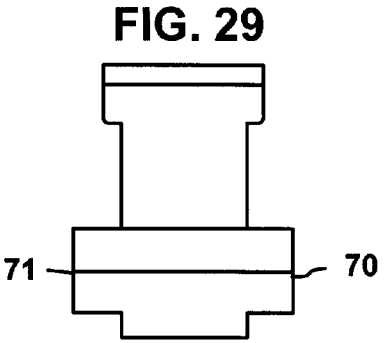
FIG. 29 is a rear view of the sliding member of the window operating handle of FIG. 27 showing the sliding member from the right side of FIG. 27.
Figure 32:
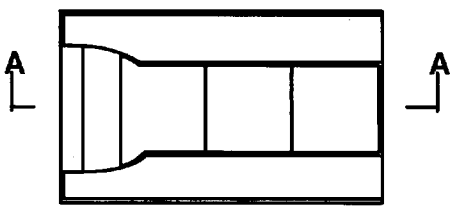
FIG. 32 is a top view of the sliding member of the window operating handle of FIG. 27.

As depicted in FIGS. 19 and 20, the pivotal member 3 may be generally rectangular or cubicle in shape with cuts and orifices present in it. The pivotal member 3, while being able to partially rotate within the cavity E about pin 5, may be able to attain such positions, relative to the handle, which correspond to a "folded" or an "operating" positions of the handle. In order to provide such ability, many configurations of the pivotal member and handle may be used. For example, as shown in FIG. 19, the top portion of the pivotal member 3 may have a flat surface 101 with at least two flanged edges 102 and 103 extending outwardly from two sides of the pivotal member 3 on or near the top surface. These edges 102 and 103 may be about as wide as or wider than the width of the assembly body 2. The flanged edges 102 and 103 are generally wider than width of the cavity E in which the pivotal member 3 may be positioned. A combination of the position of the pivotal member 3 in the cavity E of the assembly body 2 and configuration of the flanged edges 102 and 103 of the pivotal member 3 allow the pivotal member 3, while rotating within assembly body 2, to be able to stop when flanged edges 102 and 103 contact the top surface 4 of the assembly body 2 or the handle. The angle between the surface 43 and surface 44 of the assembly body 2 may determine the angle between a "folded" and an "operating" positions of the handle. Pivotal member 3 is housed in the cavity E of the assembly body 2 generally between the side walls of the cavity E. The pivotal member 3 has a top surface 101 with flanged edges 102 and 103, a bottom surface 104 and typically four side walls 105, 106, 107 and 108 extending from the underside of the flanges 102 and 103 on the top surface 101 to the bottom surface 102. As depicted in FIG. 19, top surface 101 has an orifice 109 therein for receiving the drive mechanisms of a casement window (not shown). Extending from the side wall 105 to the side wall 106 generally parallel to the top surface 101 is a second orifice 110, as depicted in FIG. 20. This orifice 110 receives pin 5. Pin 5 is secured to the first sidewall portion 39 of the assembly body 2 and permits the pivotal member 3 to pivot from a first farthest position to a second farthest position that typically correspond to an "operating" or "folded" position of the handle. The bottom surface 104 of the pivotal member 3 rests upon the interior surface 37 of the cavity E of the assembly body 2. As depicted in FIG. 20, the pivotal member 3 also has a bulging portion 111 that extends from the junction where the bottom surface 104 meets the side wall 107. This bulging portion 111 engages the sliding member in a manner discussed below, providing either a "folded" or an "operating" position of the handle. On the side of the bottom surface 104 opposite the bulging portion 111 there is a diagonal portion 112 where the bottom surface 104 meets the side wall 108. The purpose of this diagonal portion 112 is to better fit the inner cavity E of the first sidewall portion 39 for assembly purposes.

As shown in FIG. 22, the pivotal member 3 also may have a spline portion 113 of the orifice 109 that allows the handle to be coupled with the window shaft (not shown). As depicted in FIG. 20, there may be an aperture 120 that is located on the side surface 108 of the pivotal member 3 toward inner surface of a spline portion 113. The aperture 120 may be configured to receive screw or pin (not shown) to prevent the handle and the shaft from disengaging.

As depicted in FIG. 1, because the pivotal member 3 may be firmly connected with window shaft through the orifice 104 and because the body housing 2 may be firmly connected with assembly body 2 when the latter is positioned on the former through pillars 15 and 16 and when heads 59 are formed, and when the assembly body 2 is pivotally connected with the pivotal member 3, such configuration allows the handle to rotate around the pin 5 relative to the pivotal member 3, and therefore, relative to the window shaft. When the pivotal member is positioned in the cavity E of the assembly body 2, and pin 5 is inserted through apertures 89 of the assembly body and orifice 90 of the pivotal member 3, as depicted in FIG. 4, the revolving movement of the pivotal member 3 around pin 5 may be restricted when flanged surface 102 and 103 of the pivotal member 3 are pressed against edges 44 of the assembly body 2.

In order to secure the position of the pivotal member as an "operating" or a "folded," meaning to prevent an accidental rotation of the pivotal member 3 relative to the assembly body 2, the present invention may use the shape of the bulging portion 111 of the pivotal member 3 to secure the position of the handle. Such shape may be in any form, and this configuration of the bulging portion 111 of the pivotal member 3 may have a shape of semi-cylinder, semi-sphere or any similar shape, preferably with smooth surface. As depicted in FIG. 19, this invention has a bulging portion 111 that would make available the pivotal member 3 to be positioned and thereafter secured in a "folded" or an "operating" position. The bulging portion 111 may have a shape of rectangular with rounded corners or the shape of semi-cylinder. Surfaces 121 and 122, preferably flat, may be formed on the opposite sides of such portion 111. These surfaces may help to provide better resistance to the dislocation of the pivotal member 3 from the fixed "operating" or "folded" position. The semi-cylindrical or semi-sphere surface 123, which may engage into a contact with sliding member, may provide an unstable intermediate position for the pivotal member 3 relative to the assembly body 2 inducing the pivotal member 3 to take farthest positions while revolving around pin 5 corresponding to a "folded" and an "operating" positions of the handle. It will be appreciated that such bulging portion 111 may be located in some other places of the pivotal member 3 in order to engage into a contact with the sliding member 4.

Figure 33:
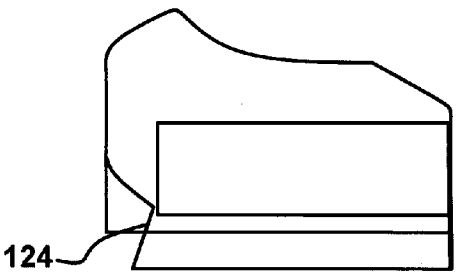
FIG. 33 is a cut-away side view of the sliding member of the window operating handle taken along the line A-A shown in FIG. 32.
Figure 31:
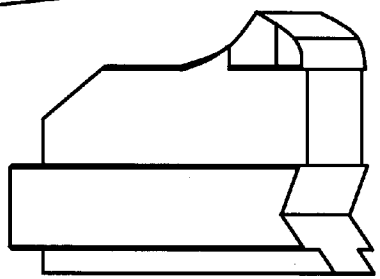
FIG. 31 is a perspective side view of the sliding member of the window operating handle of FIG. 27 showing the sliding member from the right side.

It is desirable that the sliding member 4 have such configuration to fit the contacting surfaces 121, 122 and 123 of the bulging portion 111 of the pivotal member 3. Such result, as depicted in FIGS. 31 and 33, may be achieved if the front portion 124 of the sliding member 4 has such a surface that while interacting with bulging portion 111 of the pivotal member 3, the latter would induce the former to be in either two positions that correspond an "operating" or a "folded" position. Therefore, the front portion 124 of the sliding member 4 may have grooves, cuts or detents on its surface formed in such way, that when bulging portion 18 of the pivotal member 3 gets in touch with the front portion 124 of the sliding member 4, the sliding member 4 compels the pivotal member 3 to take either an "operating" or a "folded" position.

The sliding member 4 has a bottom surface 19 that rests on the interior surface of the assembly body 2. The sliding member 4 is generally positioned within the cavity F of the assembly body 2 in the region of the second sidewall portion 41 of the assembly body 2.

Sliding member 4 has a body portion 126 with a pair of side walls 127, 128, as depicted in FIG. 5. Extending from each of the side walls 127 and 128 there are wings 70 and 71. The upper surface 129 of the sliding member 4 has a peak portion 131; the upper surface 129 of the sliding member 4 generally slopes downwardly from the apex 130 of the peak portion 131 of the sliding member 4 to flat section 132. The edge 133 of the flat section 132 connects to diagonal section 78 which ends in the tip 83. As seen in FIGS. 27-33, the tip may be eliminated.

Figure 27:
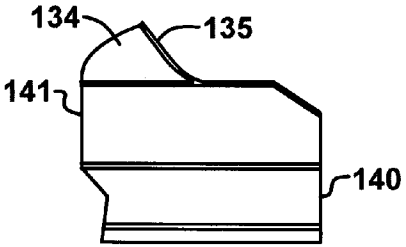
FIG. 27 is a side view of the sliding member of the window operating handle.
Figure 30:
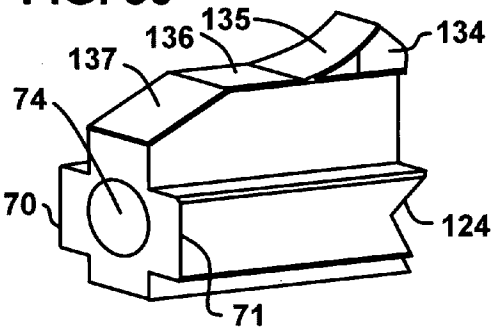
FIG. 30 is a perspective side view of the sliding member of the window operating handle of FIG. 27 showing the sliding member from the right side.
Figure 36:
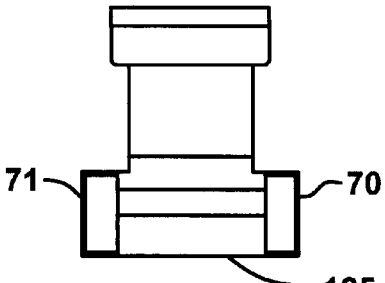
FIG. 36 is a rear view of the alternative embodiment of the sliding member of the window operating handle of FIG. 34 showing the sliding member from the right.

The peak portion 131 of the sliding member 4 may be bounded by surfaces 134 and 135, as depicted in FIGS. 27 and 30. Although the shape of the peak portion 131 may vary, the present configuration has slightly inclined surface composed by the convex surface 134, the concave surface 135 and two flat surfaces 136 and 137 correspondingly. The concave surface 135 may accommodate the extension bulging portion 111 of the pivotal member 3. As depicted in FIG. 1, when the handle is in "operate" position, such extension 111 is snapped into the concave surface 135.

The handle is configured so that when all elements of the handle are assembled, the movement of the pivotal member from a folded position to an operating position causes the bulging portion or protruding member 111 of the pivotal member 3 to move the sliding member 4 back and forth. The force of the compressed spring 6, presses against the front portion 126 of the sliding member 4 and forces the sliding member 4 into contact with the pivotal member 3. As shown in FIG. 1, when the handle is being moved from a "folded" position, the front portion 126 of the sliding member 4 begins to slide around the bulging portion 111 of the pivotal member 4 in such manner that the surface 73 of the sliding member 4 slides over the surface 59 toward surface 61 of the bulging portion 111 of the pivotal member 3 until the surface 72 of the sliding member 4 disengages with the surface 61 of the bulging portion 111 of the pivotal member 3. As a result of such rotation, the sliding member 4 is pushed backward, increasing the pressure upon of the spring 6. Such pressure reaches the climax when the handle is in the intermediate position, i.e. when sliding member 4 is forced to move by the bulging portion 111 to the farthermost possible point at the moment when the surface 60 of the bulging portion 111 of the pivotal member engages the surface 140 of the front portion 126 of the sliding member 4. In such intermediate position, the curved surface 60 of the bulging portion 111 of the pivotal member 3 is pressed against the flat surface of the sliding member 4. The further rotation of the handle from a "folded" to the "operating" position would result on a sliding of the surface 141 of the rear portion of the sliding member 4 over the surface 60 of the bulging portion 111 of the pivotal member 3 and then, when the surface 141 of the rear portion of the sliding member 4 reaches the surface 61 of the bulging portion 111 of the pivotal member 3, the resistance of the spring 6 upon the sliding member would cause the latter to slide back toward the pivotal member 3 until the surface 111 of the front portion 141 of the sliding member 4 is pressed against the surface 61 of the bulging portion 111 of the pivotal member 3. This position of the sliding member 4 relative to the pivotal member 3 would relate to the "operating" position of the handle. When the handle is moved to its folded position, the bulge of the pivot member moves toward the inside surface 37 of the handle. As the pivot member 3 moves, the bulge rides from the tip 130 along surface 134.

The force that may be applied to the handle in order to overcome the resistance of the spring 6 and the bulge 111, and therefore, to disengage the handle from either "folded" or "operating" position, creates a good tactile indication that the handle is in either position. In order to engage the handle back in a "folded" position, the handle may be move in the opposite direction.

Preferably, the pivotal member 3 and the sliding member 4 may be made from such materials as a wear-resistant plastic; but it is also may be made from variety of materials that provide low cost of manufacturability, flexibility, wear resistance and fatigue resistance. Such materials may be metal or metal alloys, ceramics, composites etc.

Those skilled in the art will readily appreciate that many modifications of the exemplary embodiment are possible without materially departing from the novel teachings and advantages of this invention. For example, various configuration of the pivotal and sliding member may be used if used at all. Different types of the resistance providing elements may be used to supply resistance to the movement of the handle from a "folded" to an "opened" position. Alternative mechanisms may provide for the coupling of various parts of the handle, different types of the engagement between the sliding and the pivotal members, between the sliding member and the assembly body, between the pivotal member and the assembly body or between the assembly body and the handle body. Furthermore, alternative shapes and configuration may be used for the sliding member, the pivotal member, the assembly body or the knob. All such variations and modifications intended to be included within the scope if this invention as defined in the following claims.

Other modifications, substitutions, omissions and changes may be made in the design, size, materials used or proportions, operating conditions, arrangement or positioning of elements and members of the preferred embodiment without departing from the spirit of this invention as described in the following claims.

What is claimed is:

1. A window operator handle securable to the casement window operating drive shaft, said handle being movable between a first position to a second position, said handle comprising a body housing, the body housing having a top surface and a pair of side surfaces that form a cavity in the housing, said cavity having an assembly body secured to said housing, a pivotal member positioned in a first section of said assembly body and a sliding member positioned in at least a second portion of said assembly body, said pivotal member being adapted to pivot from a first position to a second position as said handle is moved from a first position to a second position, said pivotal member having a protrusion extending from a side of said pivotal member and contacting a side of said sliding member, said pivotal member being held in said first position and said second position by said sliding member, said sliding member being retained in contact with said pivotal member by a spring means in said assembly body; and wherein said housing has a first portion and a second portion, said pivotal member being pivotally mounted in said first portion and said sliding member being slidably mounted in said second portion;

wherein said sliding member has a body having a first and a second wing extending from said body, said first and second wing slidably retained in first and second slots in said second portion of said assembly body.

2. The handle according to claim 1 wherein said first portion of said assembly body has a first sidewall and a second sidewall and rear wall, said first and second sidewalls and said rear wall being joined together by a base, said rear wall, base and sidewalls forming said cavity.

3. A window operator handle securable to the casement window operating drive shaft, said handle being movable between a first position to a second position, said handle comprising a body housing, the body housing having a top surface and a pair of side surfaces that form a cavity in the housing, said cavity having an assembly body secured to said housing, a pivotal member positioned in a first section of said assembly body and a sliding member positioned in at least a second portion of said assembly body, said pivotal member being adapted to pivot from a first position to a second position as said handle is moved from a first position to a second position, said pivotal member having a protrusion extending from a side of said pivotal member and contacting a side of said sliding member, said pivotal member being held in said first position and said second position by said sliding member, said sliding member being retained in contact with said pivotal member by a spring means in said assembly body; and wherein said assembly body has a base and a rear wall extending upwardly from said base, said base also having a pair of sidewalls extending upwardly from said base and connected to opposite edges of said rear wall thereby forming a cavity for receiving said pivotal member;

wherein each said sidewall of said assembly body has a first sidewall portion and a second sidewall portion and said assembly body having a wall extending from the sidewall portion of one sidewall to the sidewall portion of the opposite sidewall, said sidewall portion and said wall forming a second cavity for receiving said sliding member.

4. The handle according to claim 3 wherein said pivotal member has a side that contacts a side of said sliding member such that said pivotal member pushes said sliding member toward said wall when said pivotal member is pivoted from an operating position to a folded position.

5. The handle according to claim 4 wherein said sliding member is further away from said wall when said pivotal member is in said folded position and said operating position as compared to when said pivotal member is moving from one said operating or folded position to the other of said position.

6. The handle according to claim 5 wherein said pivotal member has a protrusion on a side of said pivotal member adjacent to said sliding member and wherein the sliding member moves from a first side of said protrusion to a second side of said protrusion as said pivotal member moves from one of said operating or folded positions to the opposite position.

7. A window operator handle securable to the casement window operating drive shaft, said handle being movable between a first position to a second position, said handle comprising a body housing, the body housing having a top surface and a pair of side surfaces that form a cavity in the housing, said cavity having an assembly body secured to said housing, a pivotal member positioned in a first section of said assembly body and a sliding member positioned in at least a second portion of said assembly body, said pivotal member being adapted to pivot from a first position to a second position as said handle is moved from a first position to a second position, said pivotal member having a protrusion extending from a side of said pivotal member and contacting a side of said sliding member, said pivotal member being held in said first position and said second position by said sliding member, said sliding member being retained in contact with said pivotal member by a spring means in said assembly body; and wherein said assembly body has a base and a rear wall extending upwardly from said base, said base also having a pair of sidewalls extending upwardly from said base and connected to opposite edges of said rear wall thereby forming a cavity for receiving said pivotal member; and wherein said sliding member has a first end and a second end and a pair of sidewalls connecting said first and second ends, said first end having an orifice for receiving an end of a spring.

8. The according to claim 7 wherein said sliding member has a top surface and a bottom surface and a longitudinal member extending from said base which is slidable in a groove in said assembly body.

9. The handle according to claim 8 wherein said sliding member has a top surface with a peak portion.

10. The handle according to claim 9 wherein said protrusion on said pivotal member contacts said concave surface portion when said handle is in an operating position and contacts said convex surface portion when said handle is in a folded position.

11. The handle according to claim 9 wherein one side of said protrusion on said pivotal member contacts said concave surface portion when said handle is in an operating position and the other side of said protrusion contacts said convex surface portion when said handle is in a folded position.

12. The handle according to claim 9 wherein one side of said protrusion on said pivotal member contacts a surface on one side of the apex of said sliding member when said handle is in an operating position and the other side of said protrusion contacts a surface on the surface on the opposite side of the apex when said handle is in a folded position.

13. A window operator handle securable to the casement window operating drive shaft, said handle being movable between a first position to a second position, said handle comprising a body housing, the body housing having a top surface and a pair of side surfaces that form a cavity in the housing, said cavity having an assembly body secured to said housing, a pivotal member positioned in a first portion of said assembly body and a sliding member positioned in at least a second portion of said assembly body, said pivotal member being adapted to pivot from a first position to a second position as said handle is moved from a first position to a second position, said pivotal member being held in said first position and said second position by said sliding member, said sliding member being retained in contact with said pivotal member by a spring means in said assembly body;

said assembly body having a base and a rear wall extending upwardly from said base, said base also having a pair of sidewalls extending upwardly from said base and connected to opposite edges of said rear wall thereby forming a cavity, said pivotal member being allowed to pivot therein;

wherein said sliding member has a first end and a second end and a pair of sidewalls connecting said first and second ends, said first end having an orifice for receiving an end of a spring;

wherein said sliding member has a top surface with an apex portion and a longitudinal member extending from said sliding member which is slidable in a groove in said assembly body;

wherein said sliding member has a concave surface portion on one side of said apex and a convex surface portion on the opposite side of the apex.

14. The handle according to claim 13 wherein said protrusion on said pivotal member contacts said concave surface portion when said handle is in an operating position and contacts said convex surface portion when said handle is in a folded position.

15. The handle according to claim 13 wherein one side of said protrusion on said pivotal member contacts said concave surface portion when said handle is in an operating position and the other side of said protrusion contacts said convex surface portion when said handle is in a folded position.

16. The handle according to claim 13 wherein one side of said protrusion on said pivotal member contacts a surface on one side of the apex of said sliding member when said handle is in an operating position and the other side of said protrusion contacts a surface on the surface on the opposite side of the apex when said handle is in a folded position.

17. The handle according to claim 13 wherein said first portion of said assembly body has a first sidewall and a second sidewall and rear wall, said first and second sidewalls and said rear wall being joined together by a base, said rear wall, base and sidewalls forming said cavity.

18. The handle according to claim 13 wherein each said sidewall of said assembly body has a first sidewall portion and a second sidewall portion and said assembly having a wall extending from the sidewall portion of one sidewall to the sidewall portion of the opposite sidewall, said sidewall portion and said wall forming a second cavity for receiving a sliding member.

19. The handle according to claim 18 wherein said pivotal member has a side that contacts a side of said sliding member such that said pivotal member pushes said sliding member toward said wall when said pivotal member is pivoted from an operating position to a folded position.

20. The handle according to claim 19 wherein said sliding member is further away from said wall when said pivotal member is in said folded position and said operating position as compared to when said pivotal member is moving from one said operating or folded position to the other of said position.

21. The handle according to claim 20 wherein said pivotal member has a protrusion on a side of said pivotal member adjacent to said sliding member and wherein the sliding member moves from a first side of said protrusion to a second side of said protrusion as said pivotal member moves from one of said operating or folded positions to the opposite position.

22. The handle according to claim 21 wherein said pivotal member has a top portion and a bottom portion, wherein said top portion has a top surface having a front edge, a rear edge and two opposing side edges forming a generally rectangular shape.

23. The handle according to claim 22 wherein said protrusion of said pivotal member does not come in contact with said assembly body.

24. The handle according to claim 23 wherein said bottom portion of said pivotal member has a front wall, a rear wall and two opposing side walls.

25. The handle according to claim 24 wherein said top surface forms a flange around said bottom portion of said pivotal member.

26. The handle according to claim 25 wherein each of said sidewalls of said assembly body has parallel top surfaces.

27. The handle according to claim 26 wherein said flange contacts said top surfaces of said assembly body, when said pivoting member is in one of said first position or said second position.

28. The handle according to claim 27 wherein said pivoting member is hinged to said assembly body.

29. The handle according to claim 1 wherein said protrusion of said pivotal member does not come in contact with said assembly body.

30. A window operator handle securable to the casement window operating drive shaft, said handle being movable between a first position to a second position, said handle comprising a body housing, the body housing having a top surface and a pair of side surfaces that form a cavity in the housing, said cavity having an assembly body secured to said housing, a pivotal member positioned in a first portion of said assembly body and a sliding member positioned in at least a second portion of said assembly body, said pivotal member being adapted to pivot from a first position to a second position as said handle is moved from a first position to a second position, said pivotal member being held in said first position and said second position by said sliding member, said sliding member being retained in contact with said pivotal member by a spring means in said assembly body, said assembly body having a first sidewall and a second sidewall, said sliding member having a body having first and second wings extending therefrom said first wing being retained in a first slot in one sidewall of said assembly body and the second wing being retained in a second slot in said other sidewall of said assembly body, said wings providing back and forth movement of said sliding element;

wherein said housing has a first portion and a second portion, said pivotal member being pivotally mounted in said first portion and said sliding member being slidably mounted in said second section.

31. The handle according to claim 30 wherein said first portion of said assembly body has a first sidewall and a second sidewall and rear wall, said first and second sidewalls and said rear wall being joined together by a base, said rear wall, base and sidewalls forming said cavity.

32. The handle according to claim 31 wherein said pivotal member has a top portion and a bottom portion, wherein said top portion has a top surface having a front edge, a rear edge and two opposing side edges forming a generally rectangular shape.

33. The handle according to claim 32 wherein said protrusion of said pivotal member does not come in contact with said assembly body.

34. The handle according to claim 33 wherein said bottom portion of said pivotal member has a front wall, a rear wall and two opposing side walls.

35. The handle according to claim 34 wherein said top surface forms a flange around said bottom portion of said pivotal member.

36. The handle according to claim 35 wherein each of said sidewalls of said assembly body has parallel top surfaces.

37. The handle according to claim 36 wherein said flange contacts said top surfaces of said assembly body, when said pivoting member is in one of said first position or said second position.

38. The handle according to claim 37 wherein said pivoting member is hinged to said assembly body.

* * * * *